US011584616B2

(12) United States Patent
Yang et al.

(10) Patent No.: US 11,584,616 B2
(45) Date of Patent: Feb. 21, 2023

(54) MAINTENANCE OF PASSENGER CARRYING SYSTEM

(71) Applicant: Otis Elevator Company, Farmington, CT (US)

(72) Inventors: Ke Yang, Shanghai (CN); Wenbo Huang, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 1106 days.

(21) Appl. No.: 16/218,117

(22) Filed: Dec. 12, 2018

(65) Prior Publication Data

US 2019/0185292 A1 Jun. 20, 2019

(30) Foreign Application Priority Data

Dec. 15, 2017 (CN) ..... 201711346075.5

(51) Int. Cl.
*B66B 5/00* (2006.01)
*B66B 1/34* (2006.01)

(52) U.S. Cl.
CPC ..... *B66B 5/0025* (2013.01); *B66B 1/3461* (2013.01); *B66B 5/005* (2013.01); *B66B 5/0087* (2013.01)

(58) Field of Classification Search
CPC ..... B66B 5/0025; B66B 1/3461; B66B 5/005; B66B 5/0087; B66B 1/3446
See application file for complete search history.

(56) References Cited

U.S. PATENT DOCUMENTS 7,073,633 B2 * 7/2006 Weinberger ..... B66B 5/0025 187/247
7,172,055 B2 * 2/2007 Engel ..... B66B 5/0087 187/391

(Continued)

FOREIGN PATENT DOCUMENTS

CN 203306866 U 11/2013
CN 104229577 A 12/2014

(Continued)

OTHER PUBLICATIONS

JP6139645—machine translation (Year: 2015).*

(Continued)

*Primary Examiner* — Michael A Riegelman
(74) *Attorney, Agent, or Firm* — Cantor Colburn LLP

(57) ABSTRACT

The present invention relates to maintenance of a passenger transport system. An apparatus for maintaining a passenger transport system according to the present invention includes a wireless beacon and a personal mobile terminal. The wireless beacon is mounted substantially at a registration entrance for entering the passenger transport system to perform a maintenance operation and configured to broadcast a wireless signal to the surrounding area. The personal mobile terminal is carried by the maintenance operator and configured to sense the wireless signal when the maintenance operator approaches the wireless beacon. At least one of the wireless beacon and the personal mobile terminal is configured to automatically generate and send, based on successful sensing of the wireless signal by the personal mobile terminal, maintenance register information indicating that the corresponding maintenance operator has checked into a maintenance operation process. The present invention can significantly simplify the check-in operation.

21 Claims, 7 Drawing Sheets

(56) References Cited

U.S. PATENT DOCUMENTS

| | | | | |
|---|---|---|---|---|
| 7,353,142 | B2 * | 4/2008 | Azpitarte | H04L 67/12 702/182 |
| 7,475,122 | B2 * | 1/2009 | Azpitarte | G06F 11/0748 702/182 |
| 8,028,807 | B2 * | 10/2011 | Deplazes | B66B 5/0006 187/247 |
| 8,540,057 | B2 * | 9/2013 | Schuster | B66B 5/0006 187/247 |
| 9,092,968 | B2 * | 7/2015 | Brinton | G07C 5/008 |
| 9,213,473 | B2 * | 12/2015 | Hovi | G06F 3/0484 |
| 9,292,683 | B2 * | 3/2016 | Prakash | G06F 21/30 |
| 9,580,276 | B2 * | 2/2017 | Toutaoui | B66B 5/0025 |
| 9,734,693 | B2 * | 8/2017 | McKinley | G08B 25/10 |
| 9,776,847 | B2 * | 10/2017 | Mondal | G07C 5/0808 |
| 10,589,961 | B2 * | 3/2020 | Yang | H04W 4/027 |
| 2014/0262629 | A1 * | 9/2014 | Toutaoui | B66B 5/0025 187/393 |
| 2014/0336791 | A1 * | 11/2014 | Asenjo | G05B 13/026 700/44 |
| 2015/0251875 | A1 * | 9/2015 | Lustenberger | B66B 5/0031 700/275 |
| 2015/0284214 | A1 * | 10/2015 | Park | B66B 5/0025 187/393 |
| 2016/0185568 | A1 * | 6/2016 | Kusserow | H04W 52/0203 340/3.31 |
| 2016/0355375 | A1 * | 12/2016 | Simcik | B66B 1/468 |
| 2017/0029244 | A1 * | 2/2017 | Madarasz | B66B 5/0037 |
| 2017/0091719 | A1 * | 3/2017 | Welty | G06Q 10/20 |
| 2018/0273344 | A1 * | 9/2018 | Mason | B66B 5/0087 |
| 2018/0282116 | A1 * | 10/2018 | Tschuppert | B66B 1/463 |
| 2018/0346287 | A1 * | 12/2018 | Fragner | B66B 1/3415 |
| 2019/0185292 | A1 * | 6/2019 | Yang | B66B 5/0087 |
| 2019/0185293 | A1 * | 6/2019 | Yang | H04W 4/021 |
| 2019/0263627 | A1 * | 8/2019 | Huang | B66B 1/3461 |
| 2020/0385234 | A1 * | 12/2020 | Wei | B66B 1/3446 |
| 2020/0385235 | A1 * | 12/2020 | Wei | G01S 5/02695 |
| 2022/0073312 | A1 * | 3/2022 | Kolb | B66B 1/3461 |

FOREIGN PATENT DOCUMENTS

| | | | |
|---|---|---|---|
| JP | 6139645 | A | 2/1986 |
| JP | 6139645 | B1 * | 5/2017 |

OTHER PUBLICATIONS

Cygnet Infotech, "Intelligent Elevator Maintenance Enabled by Intuitive IoT Solution", available at: https://www.cygnet-infotech.com/media/581584/iot-integrated-with-elevators-for-germany-based-client.pdf, accessed Dec. 12, 2018, 5 pages.

Genetec, "Dynamic Security and IT Reporting", Genetec Inc., 2017, 2 pages.

Karpischek et al., "A Maintenance System Based on Near Field Communication", abstract, 2009 Third International Conference on Next Generation Mobile Applications, Services and Technologies, Date of Conference: Sep. 15-18, 1 page.

Recipes@WatsonIoT, "Monitor Elevator events in real time to take corrective actions using Watson IoT Platform", IBM, published Nov. 30, 2016, 26 pages.

T-Systems, "Information and communication technology by T-Systems", available at: https://www.t-systems.com/de/en/references/use-cases/use-case/schindler-internet-of-things-239450, accessed Dec. 12, 2018, 6 pages.

European Search Report for Application No. 18210831.6; dated Nov. 19, 2020; 8 Pages.

* cited by examiner

MAINTENANCE OF PASSENGER CARRYING SYSTEM

FOREIGN PRIORITY

This application claims priority to Chinese Patent Application No. 201711346075.5, filed Dec. 15, 2017, and all the benefits accruing therefrom under 35 U.S.C. § 119, the contents of which in its entirety are herein incorporated by reference.

TECHNICAL FIELD

The present invention relates to the technical field of passenger transport systems, and to maintenance of a passenger transport system.

BACKGROUND ART

Passenger transport systems (such as elevators, escalators, and moving walks) are increasingly widely mounted and applied in various buildings. Maintenance of a passenger transport system is very important to safe operation of the passenger transport system. Therefore, there are corresponding industrial standards to stipulate maintenance operation processes of various passenger conveying systems.

At present, maintenance of a passenger conveying system severely depends on manual operations of a maintenance operator. For example, the maintenance operator needs to make many preparations before starting a maintenance operation process for a passenger transport system, including a manual check-in operation implemented based on the paper office. Therefore, the preparations before the maintenance operation process are complex.

SUMMARY OF THE INVENTION

According to a first aspect of the present invention, an apparatus for maintaining a passenger transport system is provided, including: a wireless beacon mounted substantially at a registration entrance for entering the passenger transport system to perform a maintenance operation and configured to broadcast a wireless signal to the surrounding area; and a personal mobile terminal carried by the maintenance operator and configured to sense the wireless signal when the maintenance operator approaches the wireless beacon, wherein at least one of the wireless beacon and the personal mobile terminal is configured to automatically generate and send, based on successful sensing of the wireless signal by the personal mobile terminal, maintenance register information indicating that the corresponding maintenance operator has checked into a maintenance operation process.

The apparatus according to an embodiment of the present invention further includes: a maintenance management terminal configured to receive the maintenance register information and confirm, based on the received maintenance register information, that the corresponding personal mobile terminal has finished a check-in operation.

In the apparatus according to an embodiment of the present invention, the maintenance management terminal is configured to send a health report of the corresponding passenger transport system to the personal mobile terminal in response to receipt of the maintenance register information; and the personal mobile terminal is configured to receive the health report of the corresponding passenger transport system.

In the apparatus according to an embodiment of the present invention, the health report includes one or more of failure logging information, historical repair logging information, historical maintenance logging information, and failure prediction information.

In the apparatus according to an embodiment of the present invention, the personal mobile terminal includes: a health condition presenting unit configured to generate and present, based on the health report, a healthy state and/or an unhealthy state of one or more components in the passenger transport system that require maintenance.

In the apparatus according to an embodiment of the present invention, the personal mobile terminal further includes: a maintenance operation prompting unit configured to generate maintenance operation prompt information based on the health report and send the maintenance operation prompt information to prompt the maintenance operator to perform a corresponding maintenance operation.

In the apparatus according to an embodiment of the present invention, the health condition presenting unit is further configured to highlight one or more components that are in the unhealthy state and require maintenance.

In the apparatus according to an embodiment of the present invention, the wireless beacon has a corresponding first identity, and the first identity is broadcasted at the same time when the wireless signal is broadcasted; the personal mobile terminal has a corresponding second identity, and the personal mobile terminal is further configured to identify the first identity while sensing the wireless signal and generate and send maintenance register information including the first identity and the second identity.

In the apparatus according to an embodiment of the present invention, the personal mobile terminal has a corresponding second identity, and the personal mobile terminal is further configured to establish a connection with the wireless beacon while sensing the wireless signal and send the second identity; and the wireless beacon has a corresponding first identity, and the wireless beacon is further configured to receive the second identity and generate and send maintenance register information including the first identity and the second identity.

In the apparatus according to an embodiment of the present invention, the wireless beacon is a Bluetooth module and the wireless signal is a Bluetooth signal, or the wireless beacon is a Bluetooth low energy module and the wireless signal is a Bluetooth low energy signal, or the wireless beacon is a Wifi module and the wireless signal is a Wifi signal.

In the apparatus according to an embodiment of the present invention, the wireless beacon is configured to broadcast the wireless signal to the surrounding area within a predetermined range; and the personal mobile terminal is further configured to determine, by determining the intensity of the sensed wireless signal, whether the personal mobile terminal has entered the predetermined range, so as to determine whether the maintenance operator has approached the wireless beacon.

In the apparatus according to an embodiment of the present invention, the personal mobile terminal is configured to be capable of automatically sensing the wireless signal without establishing a wireless connection with the wireless beacon.

According to a second aspect of the present invention, a method for maintaining a passenger transport system is provided, including the following steps: a wireless beacon mounted at a registration entrance for entering the passenger transport system to perform a maintenance operation broadcasting a wireless signal to the surrounding area; a personal mobile terminal carried by the maintenance operator sensing the wireless signal when the maintenance operator approaches the wireless beacon; and at least one of the wireless beacon and the personal mobile terminal automatically generating and sending, based on successful sensing of the wireless signal by the personal mobile terminal, maintenance register information indicating that the corresponding maintenance operator has checked into a maintenance operation process.

In the method according to an embodiment of the present invention, the method further includes the following step: a maintenance management terminal receiving the maintenance register information and confirming, based on the received maintenance register information, that the corresponding personal mobile terminal has finished a check-in operation.

In the method according to an embodiment of the present invention, the method further includes the following steps: the maintenance management terminal sending a health report of the corresponding passenger transport system to the personal mobile terminal in response to receipt of the maintenance register information; and the personal mobile terminal receiving the health report of the corresponding passenger transport system.

In the method according to an embodiment of the present invention, the health report includes one or more of failure logging information, historical repair logging information, historical maintenance logging information, and failure prediction information.

In the method according to an embodiment of the present invention, the method further includes the following step: the personal mobile terminal generating and presenting, based on the health report, a healthy state and/or an unhealthy state of one or more components in the passenger transport system that require maintenance.

In the method according to an embodiment of the present invention, the method further includes the following step: the personal mobile terminal generating maintenance operation prompt information based on the health report and sending the maintenance operation prompt information to prompt the maintenance operator to perform a corresponding maintenance operation.

In the method according to an embodiment of the present invention, in the step of generating and presenting a health condition, one or more components that are in the unhealthy state and require maintenance are highlighted.

In the method according to an embodiment of the present invention, the wireless beacon has a corresponding first identity, and the first identity is broadcasted at the same time when the wireless signal is broadcasted; the personal mobile terminal has a corresponding second identity; and in the step of sensing the wireless signal, the first identity is identified, and in the step of generating and sending maintenance register information, maintenance register information including the first identity and the second identity is generated and sent.

In the method according to an embodiment of the present invention, the personal mobile terminal has a corresponding second identity, and in the step of sensing the wireless signal, the personal mobile terminal establishes a connection with the wireless beacon and sends the second identity; the wireless beacon has a corresponding first identity; and in the step of generating and sending the maintenance register information, the wireless beacon further receives the second identity and generates and sends maintenance register information including the first identity and the second identity.

In the method according to an embodiment of the present invention, the wireless beacon is a Bluetooth module and the wireless signal is a Bluetooth signal, or the wireless beacon is a Bluetooth low energy module and the wireless signal is a Bluetooth low energy signal, or the wireless beacon is a Wifi module and the wireless signal is a Wifi signal.

In the method according to an embodiment of the present invention, in the step of broadcasting the wireless signal, the wireless beacon broadcasts the wireless signal to the surrounding area within a predetermined range; and in the step of sensing the wireless signal, whether the personal mobile terminal has entered the predetermined range is determined by determining the intensity of the sensed wireless signal, so as to determine whether the maintenance operator has approached the wireless beacon.

In the method according to an embodiment of the present invention, in the step of sensing the wireless signal, the wireless signal is automatically sensed without establishing a wireless connection with the wireless beacon.

According to a third aspect of the present invention, a method for maintaining a passenger transport system is provided, including the following steps: sensing a wireless signal that is broadcasted by a wireless beacon mounted substantially at a registration entrance for entering the passenger transport system to perform a maintenance operation; and automatically generating and sending, based on successful sensing of the wireless signal, maintenance register information indicating that a corresponding maintenance operator has checked into a maintenance operation process.

The method according to an embodiment of the present invention further includes the following step: receiving a health report of the corresponding passenger transport system.

The method according to an embodiment of the present invention further includes the following step: generating and presenting, based on the health report, a healthy state and/or an unhealthy state of one or more components in the passenger transport system that require maintenance.

The method according to an embodiment of the present invention further includes the following step: generating maintenance operation prompt information based on the health report and sending the maintenance operation prompt information to prompt the maintenance operator to perform a corresponding maintenance operation.

In the method according to an embodiment of the present invention, in the step of presenting the health condition, one or more components that are in the unhealthy state and require maintenance are highlighted.

In the method according to an embodiment of the present invention, in the sensing step, a first identity of the wireless beacon is identified at the same time; and in the step of generating and sending maintenance register information, maintenance register information including the first identity and a second identity of the personal mobile terminal is generated and sent.

In the method according to an embodiment of the present invention, the wireless signal is a Bluetooth signal, a Bluetooth low energy signal, or a Wifi signal.

In the method according to an embodiment of the present invention, in the sensing step, the intensity of the sensed wireless signal is determined.

According to a fourth aspect of the present invention, a personal mobile terminal for maintaining a passenger transport system is provided, which can be carried by a maintenance operator that performs a maintenance operation process; and the personal mobile terminal includes: a near field communication unit configured to sense a wireless signal that is broadcasted by a wireless beacon mounted at a registration entrance for entering the passenger transport system to perform a maintenance operation; a maintenance register information generating unit configured to automatically generate, based on successful sensing of the wireless signal, maintenance register information indicating that the maintenance operator has checked into a maintenance operation process; and a remote communication unit configured to send the maintenance register information.

The personal mobile terminal according to an embodiment of the present invention further includes: a health report acquiring unit configured to acquire a health report of the corresponding passenger transport system.

The personal mobile terminal according to an embodiment of the present invention further includes: a health condition presenting unit configured to generate and present, based on the health report, a healthy state and/or an unhealthy state of one or more components in the passenger transport system that require maintenance.

In the personal mobile terminal according to an embodiment of the present invention, the personal mobile terminal further includes: a maintenance operation prompting unit configured to generate maintenance operation prompt information based on the health report and send the maintenance operation prompt information to prompt the maintenance operator to perform a corresponding maintenance operation.

In the personal mobile terminal according to an embodiment of the present invention, the health condition presenting unit is further configured to highlight one or more components that are in the unhealthy state and require maintenance.

In the personal mobile terminal according to an embodiment of the present invention, the near field communication unit is further configured to identify a first identity of the wireless beacon, and the maintenance register information generating unit is further configured to generate and send maintenance register information including the first identity and a second identity of the personal mobile terminal.

In the personal mobile terminal according to an embodiment of the present invention, the near field communication unit is a Bluetooth communication unit, a Bluetooth low energy communication unit, or a Wifi communication unit.

The personal mobile terminal according to an embodiment of the present invention further includes a signal intensity determining unit configured to determine the intensity of the sensed wireless signal.

According to a fifth aspect of the present invention, a computer device is provided, including a memory, a processor, and a computer program that is stored in the memory and can be run in the processor, wherein the processor implements the steps of the method described in the third aspect when executing the program.

According to a sixth aspect of the present invention, a computer readable storage medium is provided, which stores a computer program, wherein the program is executed by a processor to implement the steps of the method according to any of claims 1 to 8.

According to a seventh aspect of the present invention, a wireless beacon for maintaining a passenger transport system is provided, wherein the wireless beacon is mounted substantially at a registration entrance for entering the passenger transport system to perform a maintenance operation and is configured to be capable of broadcasting a wireless signal to the surrounding area; and the wireless beacon includes: a maintenance register information generating unit configured to automatically generate, based on successful sensing of the wireless signal by a personal mobile terminal carried by a maintenance operator, maintenance register information indicating that the maintenance operator has checked into a maintenance operation process; and a maintenance register information sending unit configured to send the maintenance register information.

In the wireless beacon according to an embodiment of the present invention, the wireless beacon has a corresponding first identity, the wireless beacon is further configured to receive a second identity of the personal mobile terminal, and the maintenance register information generating unit is further configured to generate and send maintenance register information including the first identity and the second identity.

In the wireless beacon according to an embodiment of the present invention, the wireless beacon is a Bluetooth module, a Bluetooth low energy module, or a Wifi module.

According to an eighth aspect of the present invention, a maintenance management terminal for maintaining a passenger transport system is provided, wherein the maintenance management terminal at least can establish a wireless connection with a personal mobile terminal carried by a maintenance operator; and the maintenance management terminal includes: a maintenance register information acquiring unit configured to receive maintenance register information corresponding to the personal mobile terminal and confirm, based on the received maintenance register information, that the corresponding personal mobile terminal has finished a check-in operation.

The maintenance management terminal according to an embodiment of the present invention further includes: a health report sending unit configured to send a health report to the corresponding personal mobile terminal in response to receipt of the maintenance register information.

The maintenance management terminal according to an embodiment of the present invention further includes: a health report generating unit configured to dynamically generate or update the health report.

The above features and operations of the present invention will become more obvious according to the following description and accompanying drawings.

BRIEF DESCRIPTION OF THE DRAWINGS

The above and other objectives and advantages of the present invention will be more complete and clearer through the following detailed description with reference to the accompanying drawings, wherein identical or similar elements are marked with identical reference numerals.

DETAILED DESCRIPTION

Figure 1:
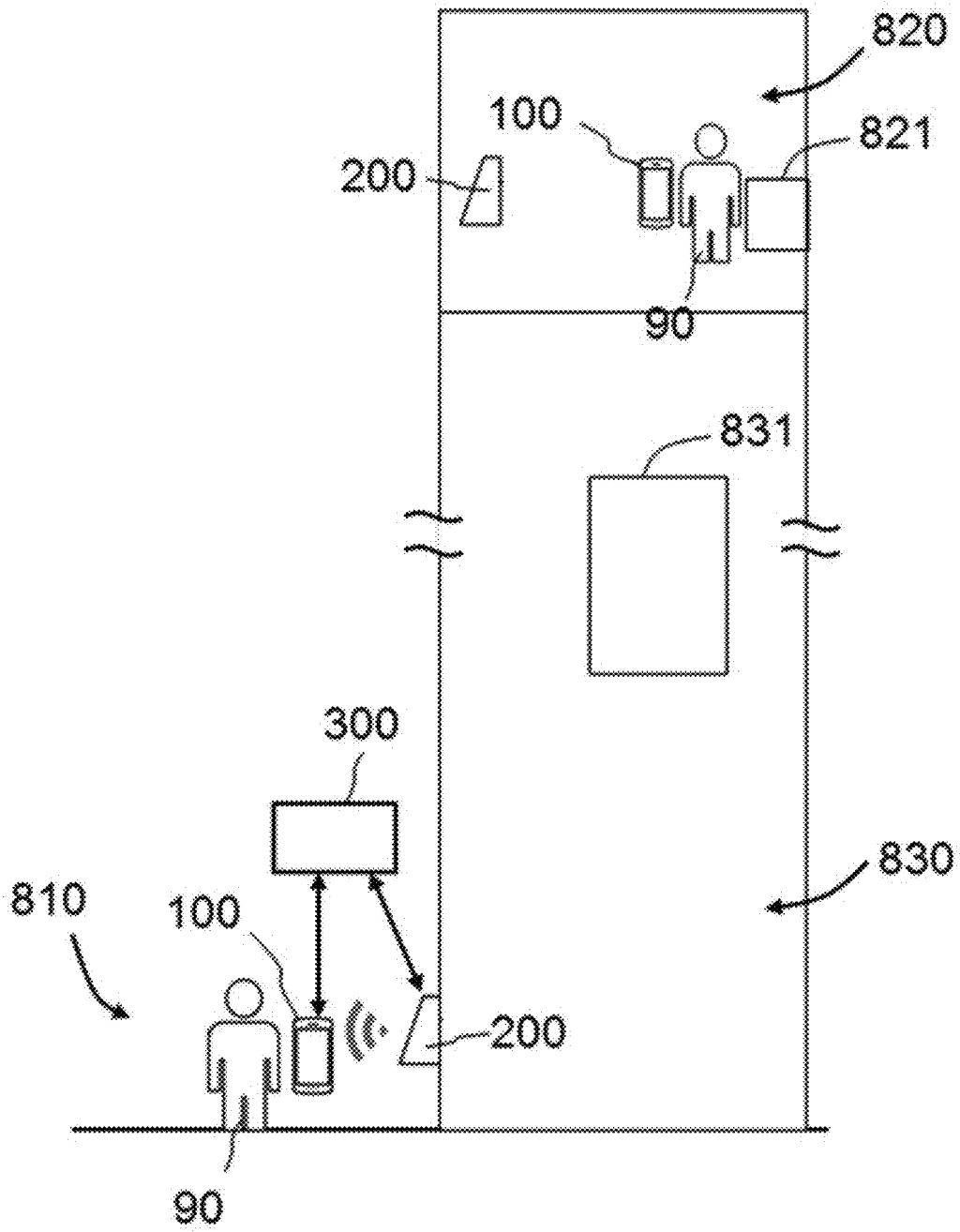
FIG. 1 is a schematic diagram of an apparatus for maintaining a passenger transport system according to an embodiment of the present invention.

The present invention will be described more thoroughly with reference to the accompanying drawings, and the accompanying drawings show exemplary embodiments of the present invention. However, the present invention can be implemented in many different forms and should not be construed as being limited by the embodiments described here. On the contrary, these embodiments are provided such that the present disclosure becomes thorough and complete, and concepts of the present invention are fully conveyed to those skilled in the art. In the accompanying drawings, identical reference numerals denote identical elements or components, and therefore, their descriptions will be omitted.

Some block diagrams shown in the accompanying drawings are functional entities, and they are not necessarily corresponding to physically or logically independent entities. These functional entities can be implemented in a software form, or in one or more hardware modules or integrated circuits, or in different networks and/or processor apparatuses and/or micro-processor apparatuses.

The present invention will be described in the following with reference to the flowchart illustrations, block diagrams and/or flowcharts of the method and apparatus according to the embodiments of the present invention. It should be understood that these flowchart illustrations and/or each block of the block diagrams, and a combination of the flowchart illustrations and/or the block diagrams can be implemented by computer program instructions. These computer program instructions can be provided to a processor of a general-purpose computer, a special-purpose computer, or another programmable data processing device to form a machine, such that the processor of the computer or another programmable data processing device executes these instructions to create components for implementing these flowcharts and/or blocks and/or functions/operations specified in on or more flowchart blocks.

These computer program instructions can be stored in a computer readable memory. These instructions can instruct a computer or another programmable processor to implement functions in a specific manner, such that these instructions stored in the computer readable memory construct a manufactured product including instruction components that implement functions/operations specified in one or more blocks of the flowcharts and/or block diagrams.

These computer program instructions can be loaded to a computer or another programmable data processor such that a series of operation steps are executed on the computer or another programmable processor to construct a progress implemented by the computer. Therefore, these instructions executed in the computer or another programmable data processor provide steps for implementing functions or operations specified in one or more blocks of the flowchart and/or the block diagram. It should be further noted that in some alternative implementations, the functions/operations shown in the blocks may not occur according to the order shown in the flowchart. For example, two blocks shown sequentially may actually be executed basically at the same time or these blocks can be executed in a reversed order sometimes, which specifically depends on the involved functions/operations.

In this text, for ease of description, an "apparatus for maintaining a passenger transport system" of the present invention is briefly referred to as a "maintenance apparatus", and a "method for maintaining a passenger transport system" of the present invention is briefly referred to as a "maintenance method".

In the present invention, the passenger transport system can be an Elevator system, an Escalator system, or a Moving Walk system. A personal mobile terminal, a wireless beacon, a maintenance management terminal, a maintenance apparatus, and a maintenance method of the present invention are exemplified based on an example of maintaining an elevator system. Based on the following example, those skilled in the art will understand that the personal mobile terminal, wireless beacon, maintenance management terminal, apparatus and method of the present invention can be analogically applied to maintenance of other types of passenger transport systems, such as an escalator system and a moving walk system. Changes in applicability and other changes that may need to occur are acquirable by those skilled in the art under the teaching of the embodiments of the present invention.

Figure 2:
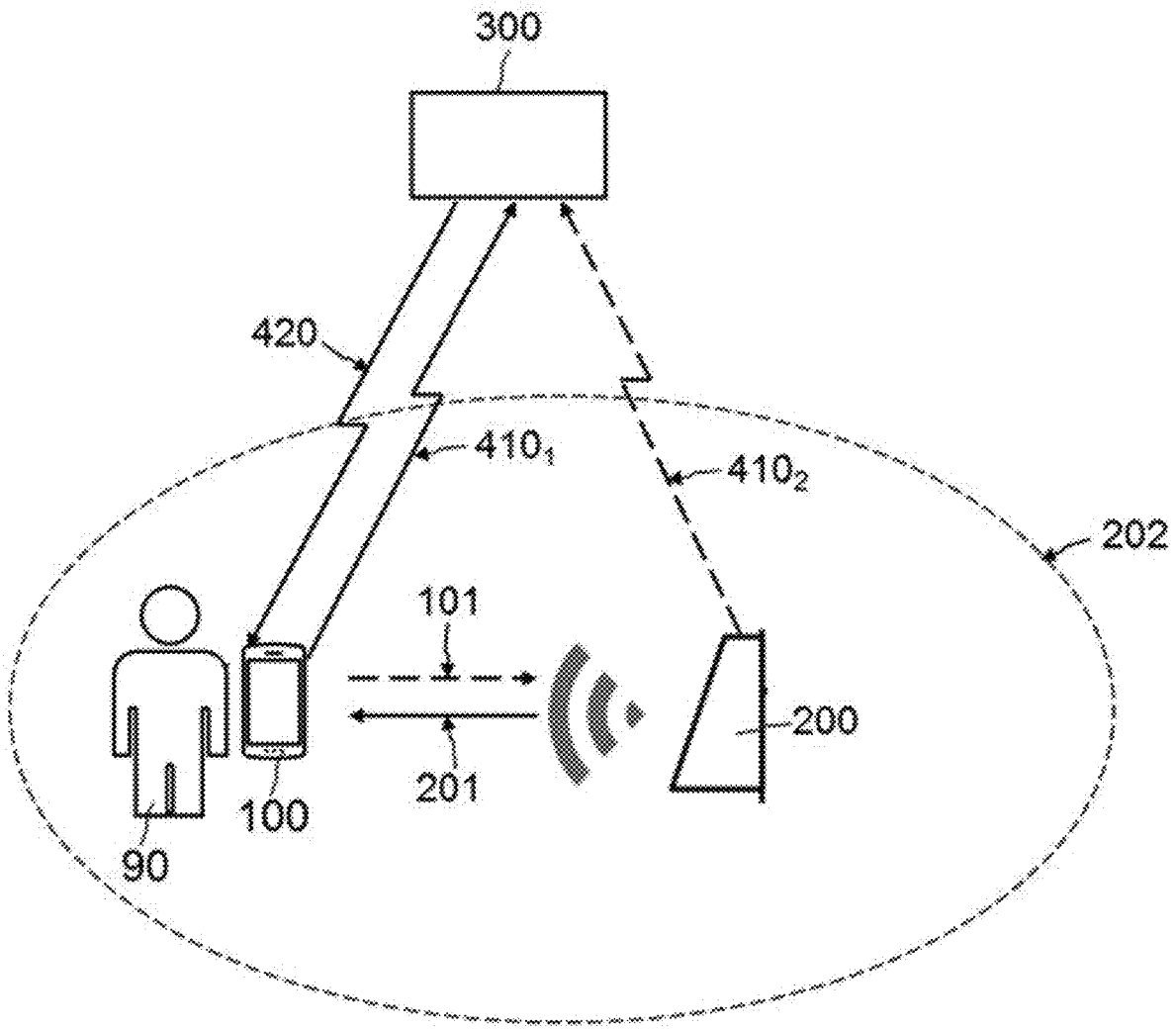
FIG. 2 is a schematic diagram of an apparatus for maintaining a passenger transport system according to an embodiment of the present invention.

FIG. 1 is a schematic diagram of an apparatus for maintaining a passenger transport system according to an embodiment of the present invention. FIG. 2 is a schematic diagram of an apparatus for maintaining a passenger transport system according to an embodiment of the present invention. The maintenance apparatus in the embodiments shown in FIG. 1 and FIG. 2 can include a personal mobile terminal 100 and a wireless beacon 200 according to an embodiment of the present invention and can further include a maintenance management terminal 300 according to an embodiment of the present invention. The personal mobile terminal 100, the wireless beacon 200, the maintenance management terminal 300, and the maintenance apparatus according to the embodiments of the present invention are exemplified in detail in the following with reference to FIG. 1 to FIG. 5.

As shown in FIG. 1, a target object of a maintenance operation, i.e., an elevator system, is mounted in a building, for example, mounted in a machine room 810 and a lifting channel 830, and correspondingly has a corresponding landing area 810. The machine room 810 and/or lifting channel 830 are/is provided with a corresponding component 821 that requires maintenance. An elevator car 831 can travel vertically in the lifting channel 830. One or more components disposed on the elevator car 831 may also require a maintenance operation. In an embodiment, a registration entrance for entering the elevator system to perform a maintenance operation is the landing area 810 (e.g., a lobby landing on the first floor). In another example, the registration entrance for entering the elevator system to perform the maintenance operation may also be an entrance position of the machine room 810. It should be understood that the position of the registration entrance for performing the maintenance operation may change correspondingly according to changes in the maintenance operation process and the like, and the specific position of the registration entrance in the passenger transport system is not limited.

Figure 4:
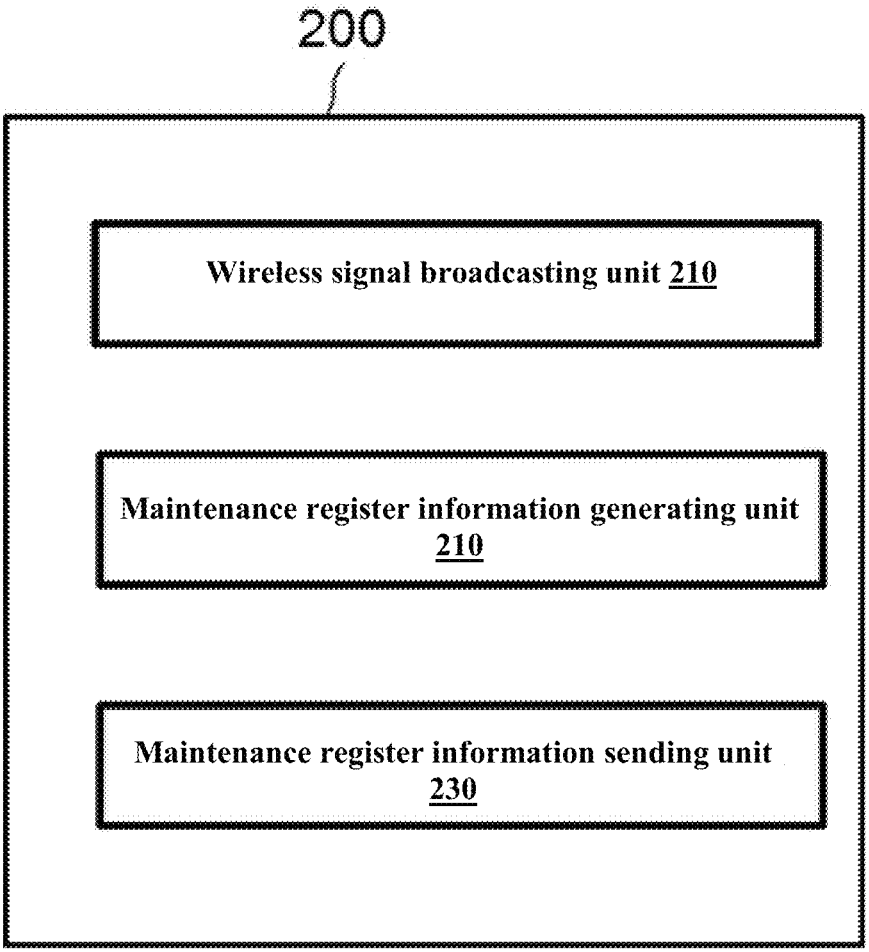
FIG. 4 is a schematic diagram of a modular structure of a wireless beacon according to an embodiment of the present invention.

As shown in FIG. 1, the wireless beacon 200 is mounted substantially at a registration entrance for entering the elevator system to perform a maintenance operation (e.g., mounted in the lobby landing area 810 or mounted in the entrance position of the machine room 810), and the wireless beacon 200 is configured to broadcast a wireless signal to the surrounding area. In an embodiment, as shown in FIG. 4, a wireless signal broadcasting unit 210 can be used to broadcast a wireless signal of a corresponding type or at a corresponding frequency. By means of the broadcasted wireless signal, interaction may be performed with the personal mobile terminal 100 that approaches the wireless beacon 200.

Figure 3:
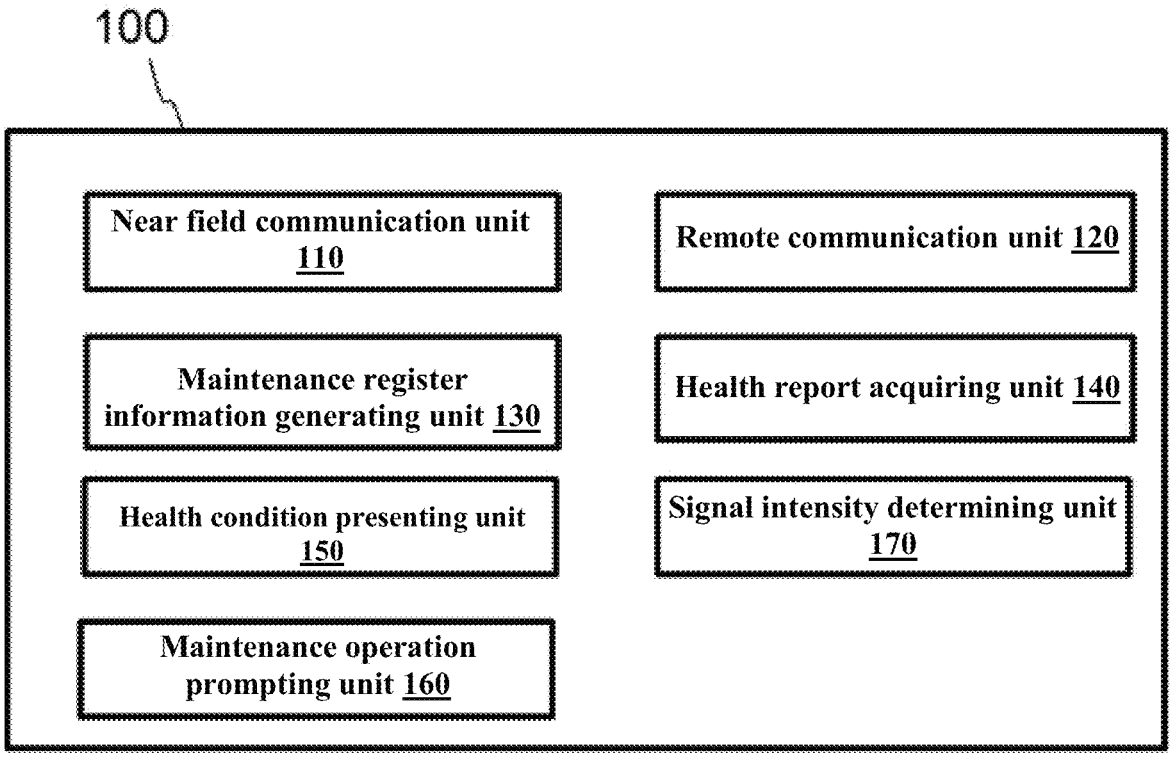
FIG. 3 is a schematic diagram of a modular structure of a personal mobile terminal according to an embodiment of the present invention.

The personal mobile terminal 100 is carried by a maintenance operator 90. In an application scenario, as shown in FIG. 1, the maintenance operator 90 needs to perform a maintenance operation on an elevator system, and therefore first approaches the registration entrance for performing the maintenance operation (e.g., the lobby landing area 810). The personal mobile terminal 90 is configured to sense the wireless signal when the maintenance operator 90 approaches the wireless beacon 200. In an embodiment, as shown in FIG. 2, the wireless beacon 200 is configured to broadcast a wireless signal to the surrounding area within a predetermined range 202. Correspondingly, the personal mobile terminal 100 is provided with a signal intensity determining unit 170 (as shown in FIG. 3), and the signal intensity determining unit 170 can determine the intensity of the wireless signal sensed by the personal mobile terminal 100. For example, the predetermined range 202 represents a wireless signal coverage in which the signal intensity is greater than or equal to a predetermined value. When the signal intensity of the wireless signal sensed by the personal mobile terminal 100 is greater than or equal to the predetermined value, it indicates that the personal mobile terminal 100 has entered the predetermined range 202. Therefore, the personal mobile terminal 100 can determine, by determining the intensity of the sensed wireless signal, whether it has entered the predetermined range 202, so as to determine whether the maintenance operator 90 has approached the wireless beacon 200.

It should be understood that the predetermined range 202 shown in FIG. 2 will basically cover the registration entrance for performing the maintenance operation. As such, when entering the elevator system to perform the maintenance operation, the maintenance operator 90 will definitely pass through the registration entrance (if conforming to the maintenance operation process) and hence sense the wireless signal. Definitely, the predetermined range 202 is not necessarily provided with an obvious boundary line as shown in FIG. 2, and the boundary of the predetermined range 202 may be a regional range.

It should be noted that the maintenance operator 90 is generally one or more maintenance workers or may be a robot capable of completing the maintenance work, or the like. The personal mobile terminal 100 is optionally a smart phone, a wearable smart device (such as a smart bracelet), a personal digital assistant (PDA), or the like, in which a processor and a memory are disposed, and a corresponding application (e.g., an APP) can be installed to help implement the function of the personal mobile terminal 100 according to an embodiment of the present invention.

In an embodiment, as shown in FIG. 2 and FIG. 3, the personal mobile terminal 100 is provided with a near field communication unit 110 configured to at least sense a wireless signal that is broadcasted by the wireless beacon 200 mounted substantially at the registration entrance for entering the elevator system to perform the maintenance operation. The personal mobile terminal 100 is further provided with a maintenance register information generating unit 130 configured to automatically generate, based on successful sensing of the wireless signal, maintenance register information $\mathbf{410}_1$ indicating that the maintenance operator 90 has checked into the maintenance operation process. For example, the maintenance register information $\mathbf{410}_1$ can be sent by a remote communication unit 120 to complete a check-in operation.

Still as shown in FIG. 2, in an embodiment, the personal mobile terminal 100 has a corresponding identity (ID) 101. In order that the personal mobile terminal 100 can know which wireless beacon 200 of which elevator system sends the wireless signal sensed by the personal mobile terminal 100, the wireless beacon 200 also has a corresponding identity (ID) 201. Moreover, the ID 201 is broadcasted at the same time when the wireless signal is broadcasted. Correspondingly, the personal mobile terminal 100 (e.g., the near field communication unit 110 thereof) identifies the ID 201 while automatically sensing the wireless signal and generates and sends maintenance register information $\mathbf{410}_1$ including the ID 101 and the ID 201. As such, a receiver of the maintenance register information $\mathbf{410}_1$ can know specific identities of the personal mobile For example, when the wireless beacon 200 is specifically a Bluetooth module (e.g., a Bluetooth low energy (BLE) module), the wireless signal broadcasted by the wireless beacon 200 is a Bluetooth signal (e.g., a Bluetooth low energy signal); correspondingly, the near field communication unit 110 of the personal mobile terminal 100 is a Bluetooth communication unit that can receive the Bluetooth signal and at the same time identify the ID 201 of the wireless beacon 200 broadcasting the Bluetooth signal. In an embodiment, the personal mobile terminal 100 or the near field communication unit 110 can sense the Bluetooth signal and identify the ID 201 in the Bluetooth signal without establishing a Bluetooth connection with the wireless beacon 200. Even the signal intensity determining unit 170 can detect the signal intensity of the received Bluetooth signal without establishing a Bluetooth connection with the wireless beacon 200. As such, the wireless signal can be sensed automatically (e.g., can be sensed automatically in an operation-free manner), and the check-in operation can be completed in an operation-free manner. Moreover, the above process is completed quickly and conveniently without the need of occupying connection capacity or a connection channel of the wireless beacon 200.

For example, when the wireless beacon 200 is specifically a Wifi module, the wireless signal broadcasted by the wireless beacon 200 is a Wifi signal; correspondingly, the near field communication unit 110 of the personal mobile terminal 100 is a Wifi communication unit that can receive the Wifi signal and at the same time identify the ID 201 of the wireless beacon 200 broadcasting the Wifi signal. In an embodiment, the personal mobile terminal 100 or the near field communication unit 110 can sense the Bluetooth signal and identify the ID 201 in the Wifi signal without establishing a Wifi connection with the wireless beacon 200. Even the signal intensity determining unit 170 can detect the signal intensity of the received Wifi signal without establishing a Wifi connection with the wireless beacon 200. As such, the wireless signal can be sensed automatically (e.g., can be sensed automatically in an operation-free manner), and the check-in operation can be completed in an operation-free manner. Moreover, the above process is completed quickly and conveniently without the need of occupying the connection capacity or connection channel of the wireless beacon 200.

In another example, the wireless beacon 200 can also be an infrared signal emission component, and correspondingly, the near field communication unit 110 of the personal mobile terminal 100 can be configured as an infrared sensor. In another embodiment, the wireless beacon 200 can also be a Near Field Communication (NFC) signal emission component, and correspondingly, the near field communication unit 110 of the personal mobile terminal 100 can be configured as an NFC communication unit.

It should be understood that the specific type of the wireless beacon 200 is not limited to the foregoing examples and can be other types of wireless beacons that can implement identical or similar functions.

In still another embodiment, the maintenance register information 410 can be generated and sent by the wireless beacon 200. As shown in FIG. 2 and FIG. 4, the wireless beacon 200 is provided with a maintenance register information generating unit 220. The maintenance register information generating unit 220 is configured to automatically generate, based on successful sensing of the wireless signal by the personal mobile terminal 100, maintenance register information $\mathbf{410}_2$ indicating that the maintenance operator 90 has checked into the maintenance operation process. For example, the maintenance register information $\mathbf{410}_2$ can be sent by a maintenance register information sending unit 230 in the wireless beacon 200 to complete the check-in operation. Specifically, when sensing the wireless signal successfully, the personal mobile terminal 100 can establish a wireless connection (e.g., a Bluetooth connection) with the wireless beacon 200, so as to feed back a corresponding signal to inform that the wireless signal broadcasted by the wireless beacon 200 has been sensed by the personal mobile terminal 100 successfully, thereby triggering the maintenance register information generating unit 220 to generate the corresponding maintenance register information $\mathbf{410}_2$ and triggering the maintenance register information sending unit 230 to send the corresponding maintenance register information $\mathbf{410}_2$. Still as shown in FIG. 2, the wireless beacon 200 has a corresponding ID 201. In order that the wireless beacon 200 can know which personal mobile terminal 100 senses the wireless signal, the personal mobile terminal 100 also has a corresponding identity (ID) 101. Moreover, the ID 101 is sent to the wireless beacon 200 at the same time when the wireless connection is established. Correspondingly, the wireless beacon 200 further receives the ID 101, and the maintenance register information generating unit 220 can generate the maintenance register information $\mathbf{410}_2$ including the ID 101 and the ID 201. Therefore, a receiver of the maintenance register information $\mathbf{410}_2$ can know specific identities of the personal mobile terminal 100 and the wireless beacon 200 that interact with each other.

Still as shown in FIG. 1 and FIG. 2, the maintenance apparatus further includes a maintenance management terminal 300. The maintenance management terminal 300 can be configured to receive the maintenance register information 410, e.g., receive the maintenance register information $\mathbf{410}_1$ from the personal mobile terminal 100, or receive the maintenance register information $\mathbf{410}_2$ from the wireless beacon 200. Based on the received maintenance register information 410, the maintenance management terminal 300 can know which maintenance operator 90 finishes a check-in operation of a maintenance operation process for which elevator system. The corresponding maintenance operator 90 can be known by analyzing the ID 101, and the corresponding elevator system can be known by analyzing the ID 201. Therefore, the maintenance management terminal 300 can further confirm, based on the received maintenance register information 410, that the corresponding personal mobile terminal 100 has finished the Check-in operation. The maintenance management terminal 300 can specifically be implemented by a server or by a cloud.

It should be noted that for ease of description, FIG. 1 and FIG. 2 merely schematically show the connection between the wireless beacon 200 of one elevator system and the maintenance management terminal 300, or the connection between one personal mobile terminal 100 and the maintenance management terminal 300. The maintenance management terminal 300 can be used for managing maintenance works of multiple elevator systems. For example, the maintenance management terminal 300 can establish connections simultaneously with multiple personal mobile terminals 100 and/or multiple wireless beacons 200.

Figure 5:
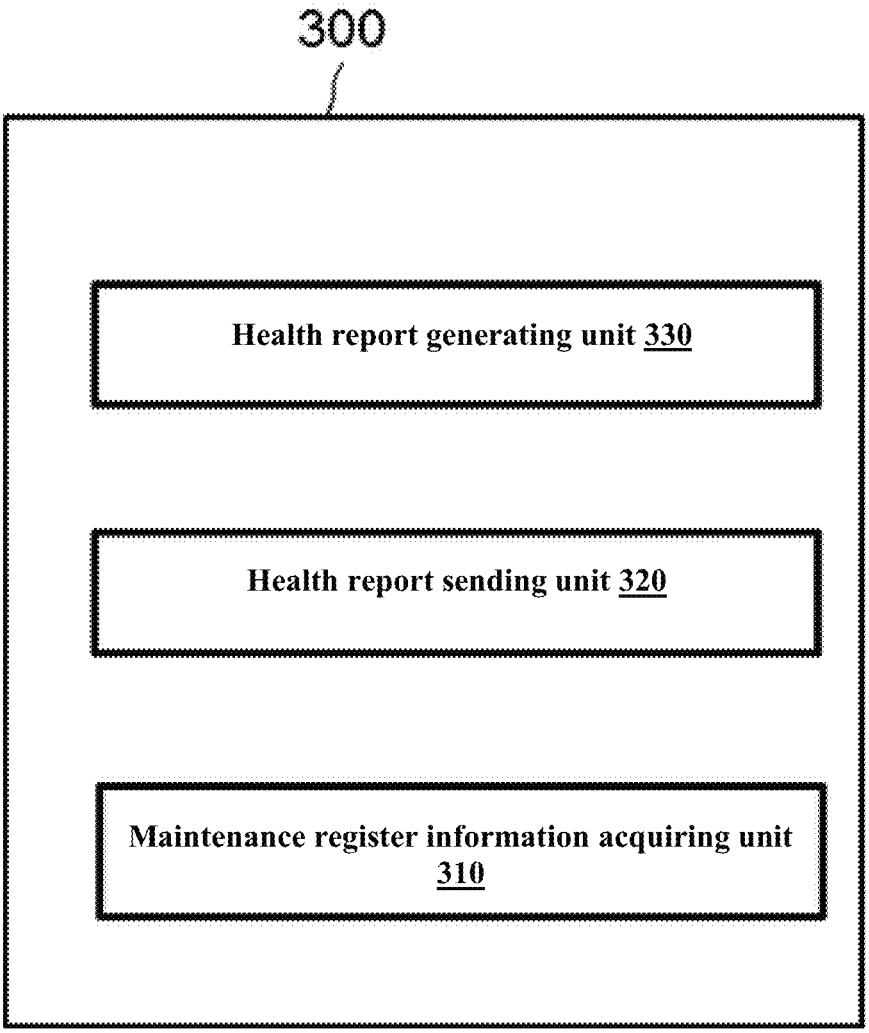
FIG. 5 is a schematic diagram of a modular structure of a maintenance management terminal according to an embodiment of the present invention.

In an embodiment, as shown in FIG. 5, the maintenance management terminal 300 is provided with a maintenance register information acquiring unit 310 configured to receive the maintenance register information 410 from the personal mobile terminal 100 or the wireless beacon 200 and confirm, based on the received maintenance register information 410, that the corresponding personal mobile terminal 100 has finished the check-in operation. When the maintenance register information $\mathbf{410}_1$ from the personal mobile terminal 100 is received, correspondingly, the personal mobile terminal 100 can establish a connection with the maintenance management terminal 300 through a remote communication unit 120. For example, a wireless network connection can be established to implement data transmission (a solid-line arrow as shown in FIG. 2) of the maintenance register information $\mathbf{410}_1$ between the personal mobile terminal 100 and the maintenance management terminal 300. When the maintenance register information $\mathbf{410}_2$ from the wireless beacon 200 is received, correspondingly, the wireless beacon 200 can establish a connection with the maintenance management terminal 300 through, e.g., a connected elevator management system, so as to implement data transmission (a dashed-line arrow as shown in FIG. 2) of the maintenance register information $\mathbf{410}_2$ between the wireless beacon 200 and the maintenance management terminal 300.

In an embodiment, as shown in FIG. 5, the maintenance management terminal 300 is provided with a health report generating unit 330. The health report generating unit 330 is configured to dynamically generate or update a health report 420. Specifically, the maintenance management terminal 300 can receive various data information that can be used to generate the health report from the elevator system, e.g., various data information collected by sensors used for detecting condition information of maintained components, or various data information input manually. Moreover, these data information can be dynamically updated correspondingly, so as to guarantee that the health report 420 is updated dynamically. It should be understood that the specific method of generating the health report 420 is not limited.

The health report 420 can reflect conditions of one or more components of the elevator system, for example, including a current condition, a historical condition, and even a predicted future condition. The conditions can include a healthy state and an unhealthy state, which can even be reflected by quantified health degree information. In an embodiment, the health report 420 can include, but is not limited to, one or more of failure logging information, historical repair logging information, historical maintenance logging information and failure prediction information. One or more of these pieces of information can be categorized and stored or analyzed and processed based on each component (e.g., 821) of the elevator system that requires maintenance.

Still as shown in FIG. 2 and FIG. 5, the maintenance management terminal 300 is further provided with a health report sending unit 320. The health report sending unit 320 sends the health report 420 of the corresponding elevator system (e.g., the elevator system corresponding to the wireless beacon 200 corresponding to the ID 201) to the corresponding personal mobile terminal 100 in response to receipt of the maintenance register information 410. As such, the maintenance operator 90 can acquire the health report 420 conveniently, and moreover, the acquired health report 420 is a relatively new health report 420.

Correspondingly, as shown in FIG. 2 and FIG. 3, the personal mobile terminal 100 is provided with a health report acquiring unit 140. The health report acquiring unit 140 acquires the health report 420 of the corresponding elevator system. As such, when passing through the lobby landing area 810, the maintenance operator 90 carrying the personal mobile terminal 100 can further automatically acquire the health report 420 of the elevator system while finishing the check-in, thus avoiding the maintenance operator 90 from acquiring various information in the health report 420 manually, such as failure logging information, historical repair logging information, historical maintenance logging information, and failure prediction information of each component (e.g., the component 821) that requires maintenance, thereby greatly reducing preparation works before entering the maintenance operation process. Moreover, the acquired health report 420 is relatively new and can more accurately reflect the health condition of the current elevator system that is going to be maintained, thus helping improve effects of the maintenance work of the maintenance operator 90.

In an embodiment, as shown in FIG. 3, the personal mobile terminal 100 is further provided with a health condition presenting unit 150. The health condition presenting unit 150 is configured to generate, based on the health report 420, a healthy state and/or an unhealthy state of one or more components (e.g., the component 821) in the to-be-maintained elevator system that require maintenance, and present (e.g., through a display interface of the personal mobile terminal 100) the healthy state and/or unhealthy state. If a component is presented as in an unhealthy state, it indicates that a corresponding maintenance operation needs to be focused on the component, or the maintenance operation needs to be performed carefully in strict accordance with the corresponding maintenance operation process. In an embodiment, the health condition presenting unit 150 is further configured to highlight (e.g., highlight with yellow) one or more components that are in the unhealthy state and require maintenance, so as to warn the maintenance operator to maintain the component strictly. It should be noted that the health condition presenting unit 150 can present the health condition on a display screen of the personal mobile terminal 100 of the maintenance operator 90 automatically, or the health condition can be presented on the display screen of the personal mobile terminal 100 of the maintenance operator 90 based on an active operation of the maintenance operator 90. The specific presentation manner is not limited. For example, the health condition can be presented based on various forms of interfaces that are easy to read.

In an embodiment, as shown in FIG. 3, the personal mobile terminal 100 is further provided with a maintenance operation prompting unit 160. The maintenance operation prompting unit 160 is configured to generate maintenance operation prompt information based on the health report 420 and send the maintenance operation prompt information to prompt the maintenance operator 90 to perform a corresponding maintenance operation. Especially for a component that is in an unhealthy state and requires maintenance, the maintenance operation prompting unit 160 can generate corresponding prompt information to prompt the maintenance operator 90 to pay attention to the integrity of the corresponding maintenance operation process. It should be noted that content of the prompt information can be generated according to the health condition of each maintained component, the type of each maintained component, the corresponding maintenance operation of each maintained component, and the like. The specific content is not limited, and any content that helps prompt the maintenance operator 90 to implement the maintenance operation completely, compliantly, and effectively can be generated. For example, the manner of sending the prompt information can be, but is not limited to, a sound playing manner. For example, as shown in FIG. 1, when the maintenance operator 90 performs a maintenance operation on the component 821 in the machine room 820, if the component 821 is marked as unhealthy in the health report 420, the maintenance operation prompting unit 160 can send corresponding prompt information in an audio playing manner so as to help the maintenance operator 90 to complete the maintenance of the component 821 smoothly.

The maintenance apparatus in the foregoing embodiment can enable the maintenance operator 90 to complete the check-in operation conveniently when the maintenance operator 90 passes through the registration entrance for the maintenance operation. When the wireless beacon such as the Bluetooth module or the WiFi module is used, the check-in operation can even be completed automatically in an operation-free manner. Therefore, the check-in operation is greatly simplified, hence helping reduce preparation works of the maintenance operator 90 before entering the maintenance operation process. Especially, while completing the check-in operation, the maintenance apparatus of the foregoing embodiment also enables the maintenance operator 90 to acquire the health report 420 of the corresponding elevator system automatically, which further greatly reduces the preparation works of the maintenance operator 90 before entering the maintenance operation process. Moreover, based on convenient presentation of the health report 420, the maintenance operator 90 can conveniently know the health condition of the component requiring maintenance in the elevator system more accurately and more thoroughly, thus improving the quality and effect of the maintenance work.

Figure 6:
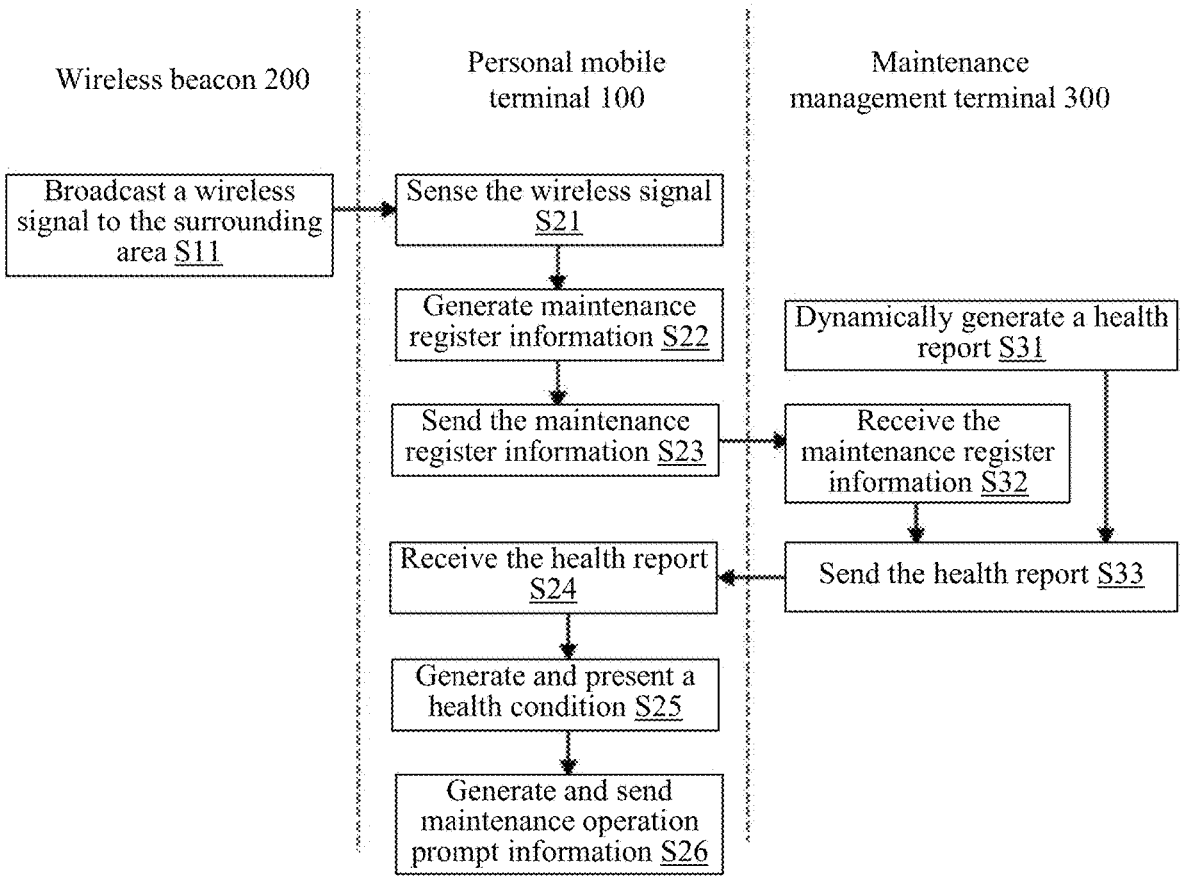
FIG. 6 is a flowchart of a method for maintaining a passenger transport system according to an embodiment of the present invention.

FIG. 6 is a flowchart of a method for maintaining a passenger transport system according to an embodiment of the present invention. In the maintenance method in this embodiment, maintenance register information is sent by a personal mobile terminal 100. The maintenance method according to the embodiment of the present invention will be exemplified in detail in the following with reference to FIG. 1 to FIG. 6.

During the maintenance, in step S11, a wireless beacon 200 mounted at a registration entrance (e.g., a lobby landing area 810) for entering an elevator system to perform a maintenance operation broadcasts a wireless signal to the surrounding area. The wireless signal can be broadcasted continuously. For example, the wireless signal can basically cover a predetermined range 202 as shown in FIG. 2. In an embodiment, the wireless beacon 200 has a corresponding ID 201, and in step S11, the ID 201 is broadcasted at the same time when the wireless signal is broadcasted.

In step S21, when a maintenance operator 90 approaches the wireless beacon 200, the personal mobile terminal 100 carried by the maintenance operator 200 automatically senses the wireless signal. In an embodiment, the wireless beacon 200 has a corresponding ID 201, and the personal mobile terminal 100 has a corresponding ID 101. In step S21, the ID 201 of the wireless beacon 200 is further identified. In an embodiment, the sensing process can be completed by the personal mobile terminal 100 automatically. For example, the maintenance operator 90 completes the sensing process in an operation-free manner.

In steps S22 and S23, in response to successful sensing of the wireless signal by the personal mobile terminal 100, maintenance register information $\mathbf{410}_1$ indicating that the corresponding maintenance operator 90 has checked into a maintenance operation process is automatically generated and sent. In an embodiment, in step S22, the maintenance register information $\mathbf{410}_1$ including the ID 201 and the ID 101 is generated and sent. As such, a receiving terminal of the maintenance register information $\mathbf{410}_1$ can know which maintenance operator 90 performs check-in for which elevator system.

In step S32, the maintenance register information $\mathbf{410}_1$ is received, and it is confirmed, based on the received maintenance register information $\mathbf{410}_1$, that the corresponding personal mobile terminal 100 has finished the check-in operation. As such, the personal mobile terminal 100 completes the check-in operation automatically in the maintenance management terminal 300.

In an embodiment, the maintenance method further includes step S31 of dynamically generating a health report 420 of the elevator system in the maintenance management terminal 300. It should be understood that step S31 is a continuous process. For example, it is required to collect or receive corresponding data continuously to generate the health report 420. Moreover, the health report 420 is relatively new with respect to the moment when the check-in operation is completed. The health report 420 can include or be generated based on one or more of failure logging information, historical repair logging information, historical maintenance logging information, and failure prediction information.

In step S33, the maintenance management terminal 300 sends the health report 420 of the corresponding elevator system to the personal mobile terminal 100 in response to receipt of the maintenance register information $\mathbf{410}_1$.

Correspondingly, in step S24, the personal mobile terminal 100 receives the corresponding health report 420. As such, when passing through the lobby landing area 810, the maintenance operator 90 carrying the personal mobile terminal 100 can further automatically acquire the health report 420 of the elevator system while completing check-in, thus avoiding the maintenance operator 90 from acquiring various information in the health report 420 manually, such as failure logging information, historical repair logging information, historical maintenance logging information, and failure prediction information of each component (e.g., a component 821) that requires maintenance, thus greatly reducing preparation works before entering the maintenance operation process. Moreover, the acquired health report 420 is relatively new and can more accurately reflect the condition state of the current elevator system that is going to be maintained, thereby helping improve effects of the maintenance work of the maintenance operator 90.

Further, in step S25, a healthy state and/or an unhealthy state of one or more components that require maintenance in the elevator system needing to be maintained currently is generated based on health report 420 and then presented. If a component is presented as in an unhealthy state, it indicates that a corresponding maintenance operation needs to be focused on the component, or the maintenance operation needs to be performed carefully in strict accordance with the corresponding maintenance operation process. In an embodiment, in step S25, one or more components that are in the unhealthy state and require maintenance are highlighted (e.g., highlighted with yellow), so as to warn the maintenance operator to maintain the component strictly. It should be noted that in step S25, the health condition can be presented on a display screen of the personal mobile terminal 100 of the maintenance operator 90 automatically, or the health condition can be presented on the display screen of the personal mobile terminal 100 of the maintenance operator 90 based on an active operation of the maintenance operator 90. The specific presentation manner is not limited. For example, the health condition can be displayed based on various forms of interfaces that are easy to read.

Further, in step S26, maintenance operation prompt information is generated based on the health report 420, and the maintenance operation prompt information is sent to prompt the maintenance operator 90 to perform a corresponding maintenance operation. The step S26 can be performed continuously in the whole maintenance operation process. Especially for a component that is in an unhealthy state and requires maintenance, corresponding prompt information can be generated to prompt the maintenance operator 90 to pay attention to the integrity of the corresponding maintenance operation process. It should be noted that content of the prompt information can be generated according to the health condition of each maintained component, the type of each maintained component, the corresponding maintenance operation of each maintained component, and the like. The specific content is not limited, and any content that helps prompt the maintenance operator 90 to implement the maintenance operation completely, compliantly, and effectively can be generated. For example, the manner of sending the prompt information can be, but is not limited to, a sound playing manner. For example, as shown in FIG. 1, when the maintenance operator 90 performs a maintenance operation on the component 821 in the machine room 820, if the component 821 is marked as unhealthy in the health report 420, the maintenance operation prompting unit 160 can send corresponding prompt information in an audio playing manner, so as to help the maintenance operator 90 to complete the maintenance of the component 821 smoothly.

Figure 7:
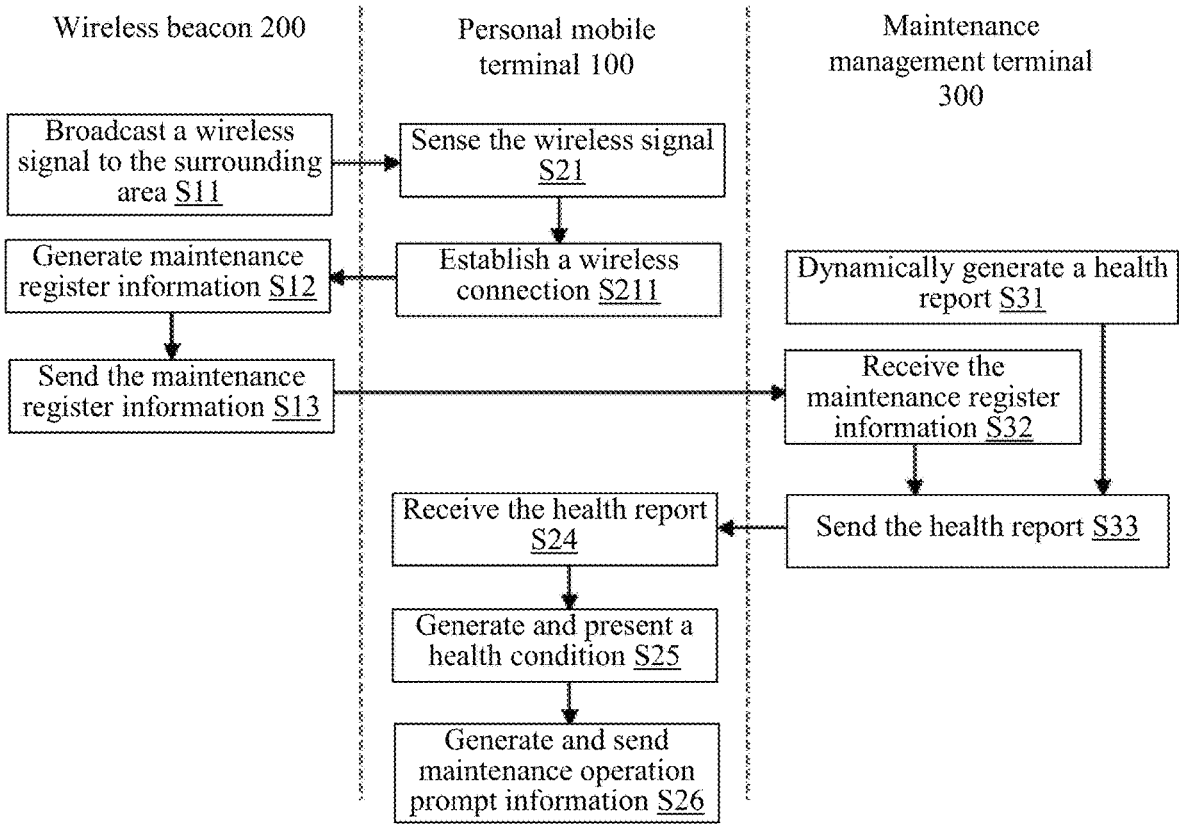
FIG. 7 is a flowchart of a method for maintaining a passenger transport system according to another embodiment of the present invention.

FIG. 7 is a flowchart of a method for maintaining a passenger transport system according to another embodiment of the present invention. In the maintenance method of this embodiment, maintenance register information is sent by a personal mobile terminal 100. The maintenance method according to the embodiment of the present invention is exemplified in detail in the following with reference to FIG. 1 to FIG. 5, and FIG. 7.

During maintenance, in step S11, a wireless beacon 200 mounted at a registration entrance (e.g., a lobby landing area 810) for entering an elevator system to perform a maintenance operation broadcasts a wireless signal to the surrounding area. The wireless signal can be broadcasted continuously. For example, the wireless signal can basically cover a predetermined range 202 as shown in FIG. 2. In an embodiment, the wireless beacon 200 has a corresponding ID 201, and in step S11, the ID 201 is broadcasted at the same time when the wireless signal is broadcasted.

In step S21, when a maintenance operator 90 approaches the wireless beacon 200, the personal mobile terminal 100 carried by the maintenance operator 200 automatically senses the wireless signal.

In step S211, the personal mobile terminal 100 establishes a wireless connection with the wireless beacon 200. For example, a Bluetooth connection can be established. In an embodiment, an ID 101 of the personal mobile terminal 100 is further sent to the wireless beacon 200. When the wireless connection is established, the wireless beacon 200 can know which personal mobile terminal 100 has automatically sensed the broadcasted wireless signal successfully.

In step S12, in response to successful receiving of the wireless signal by the personal mobile terminal 100, the wireless beacon 200 automatically generates maintenance register information $\mathbf{410}_2$ indicating that the corresponding maintenance operator 90 has checked into a maintenance operation process. In step S13, the maintenance register information $\mathbf{410}_2$ is further sent.

In step S32, the maintenance register information $\mathbf{410}_2$ from the wireless beacon 200 is received, and it is confirmed, based on the received maintenance register information $\mathbf{410}_2$, that the corresponding personal mobile terminal 100 has completed the check-in operation. As such, the personal mobile terminal 100 completes the check-in operation automatically in the maintenance management terminal 300.

In an embodiment, the maintenance method further includes step S31 of dynamically generating a health report 420 of the elevator system in the maintenance management terminal 300.

In step S33, the maintenance management terminal 300 sends the health report 420 of the corresponding elevator system to the personal mobile terminal 100 in response to receipt of the maintenance register information $\mathbf{410}_1$.

Correspondingly, in step S24, the personal mobile terminal 100 receives the corresponding health report 420.

Further, in step S25, a healthy state and/or unhealthy state of one or more components that require maintenance in the elevator system needing to be maintained currently is generated based on the health report 420 and then presented.

Further, in step S26, maintenance operation prompt information is generated based on the health report 420, and the maintenance operation prompt information is sent to prompt the maintenance operator 90 to perform the corresponding maintenance operation.

It should be understood that the maintenance apparatus and the maintenance method in the foregoing embodiments can be applied in a corresponding elevator system, escalator system, or moving walk system.

It will be understood by those skilled in the art that aspects of the present invention can be embodied as a system, method, or computer program product. Therefore, the aspects of the present invention can adopt the following forms: an entirely hardware implementation solution, an entirely software implementation solution (including firmware, resident software, microcode, and the like), or an implementation solution combining software and hardware that may all generally be referred to as a "service", "circuit", "circuit system", "module", and/or "processing system" in the text. Moreover, the aspects of the present invention can adopt a form of a computer program product embodied in one or more computer readable mediums on which computer readable program codes are implemented.

Any combination of one or more computer readable mediums can be used. The computer readable medium can be a computer readable signal medium or a computer readable storage medium. For example, the computer readable storage medium can be, but is not limited to, an electronic, magnetic, optical, electromagnetic, infrared, or semi-conductor system, device or apparatus, or any suitable combination of the foregoing items. More specific examples (a non-exhaustive list) of the computer readable storage medium will include the following items: an electrical connection having one or more wires, a portable computer magnetic disk, a hard disk, a random access memory (RAM), a read-only memory (ROM), an erasable programmable read-only memory (EPROM or flash memory), an optical fiber, a portable compact disk read-only memory (CD-ROM), an optical storage apparatus, a magnetic storage apparatus, or any suitable combination of the foregoing items. In the context of this document, the computer readable storage medium may be any tangible medium that can contain or store a program for use by or in combination with an instruction execution system, device or apparatus.

The program codes and/or executable instructions embodied in the computer readable medium can be transmitted by using any suitable medium, including, but is not limited to, a wireless medium, a wired medium, an optical cable, RF, and the like, or any suitable combination of the foregoing items.

The computer program codes for implementing the operations of the aspects of the present invention can be written by using any combination of one or more programming languages, including object-oriented programming languages such as Java, Smalltalk, and C++, and conventional procedural programming languages such as the "C" programming language or similar programming languages. The program codes can be completely executed on a computer (apparatus) of a user, partially executed on the computer of the user, executed as a stand-alone software package, partially executed on the computer of the user and partially executed on a remote computer, or completely executed on a remote computer or server. In the latter case, the remote computer can be connected to the computer of the user through any type of network connection including a local area network (LAN) or a wide area network (WAN) or can be connected to an external computer (e.g., connected to the Internet via an Internet service provider).

The computer program instructions can be provided to a processor of a general-purpose computer and a processor of a special-purpose computer such as an image processor or another programmable data processing device to generate a machine, such that the instructions executed by the processor of the computer or another programmable data processing device create a manner for implementing functions/actions specified in one or more blocks of the flowchart and/or the block diagram.

The computer program instructions can also be loaded to a computer, another programmable data processing device, or another apparatus, such that a series of operation steps are executed on the computer, another programmable device or another apparatus to generate a process implemented by the computer. Therefore, the instructions executed on the computer or another programmable device provide a process for implementing functions and actions specified in this text.

It should be further noted that in some alternative implementations, the functions/operations shown in the blocks may not occur according to the order shown in the flowchart. For example, two blocks shown sequentially actually can be executed basically simultaneously or these blocks can be executed in a reversed order sometimes, which specifically depends on the involved functions/operations. Specific step sequences are shown, disclosed and required; however, it should be understood that unless otherwise specified, the steps can be implemented in any order, can be separated, or can be combined, and will still benefit from the present disclosure.

The specification discloses the present invention by using examples, including optimal modes, and also enables any person skilled in the art to practice the present invention, including manufacturing and using any apparatus or system and performing any covered method. The patent protection scope of the present invention is defined by the claims, and can include other examples conceived of by those skilled in the art. Other examples of this kind are intended to be covered in the scope of the claims if the examples do not have any structural element different from the literal expression of the claims or if the examples include equivalent structural elements that are not essentially different from the literal expression of the claims.

What is claimed is:

1. An apparatus for maintaining a passenger transport system, comprising:

a wireless beacon mounted at a registration entrance for entering the passenger transport system to perform a maintenance operation and configured to broadcast a wireless signal to the surrounding area; and a personal mobile terminal carried by the maintenance operator and configured to sense the wireless signal when the maintenance operator approaches the wireless beacon, wherein at least one of the wireless beacon and the personal mobile terminal is configured to automatically generate and send, in response to successful sensing of the wireless signal by the personal mobile terminal, maintenance register information indicating that the corresponding maintenance operator has checked into a maintenance operation process;

a maintenance management terminal configured to receive the maintenance register information and confirm, based on the received maintenance register information, that the corresponding personal mobile terminal has finished a check-in operation.

2. The apparatus according to claim 1, wherein the maintenance management terminal is configured to send a health report of the corresponding passenger transport system to the personal mobile terminal in response to receipt of the maintenance register information; and the personal mobile terminal is configured to receive the health report of the corresponding passenger transport system.

3. The apparatus according to claim 2, wherein the health report comprises one or more of failure logging information, historical repair logging information, historical maintenance logging information, and failure prediction information.

4. The apparatus according to claim 2, wherein the personal mobile terminal comprises:

a health condition presenting unit configured to generate and present, based on the health report, a healthy state and/or an unhealthy state of one or more components in the passenger transport system that require maintenance.

5. The apparatus according to claim 4, wherein the health condition presenting unit is further configured to highlight one or more components that are in the unhealthy state and require maintenance.

6. The apparatus according to claim 2, wherein the personal mobile terminal further comprises:

a maintenance operation prompting unit configured to generate maintenance operation prompt information based on the health report and send the maintenance operation prompt information to prompt the maintenance operator to perform a corresponding maintenance operation.

7. The apparatus according to claim 1, wherein the wireless beacon has a corresponding first identity, and the first identity is broadcasted at the same time when the wireless signal is broadcasted; and the personal mobile terminal has a corresponding second identity, and the personal mobile terminal is further configured to identify the first identity while sensing the wireless signal and generate and send maintenance register information comprising the first identity and the second identity.

8. The apparatus according to claim 1, wherein the personal mobile terminal has a corresponding second identity, and the personal mobile terminal is further configured to establish a connection with the wireless beacon while sensing the wireless signal and send the second identity; and the wireless beacon has a corresponding first identity, and the wireless beacon is further configured to receive the second identity and generate and send maintenance register information comprising the first identity and the second identity.

9. The apparatus according to claim 1, wherein the wireless beacon is configured to broadcast the wireless signal to the surrounding area within a predetermined range; and the personal mobile terminal is further configured to determine, by determining the intensity of the sensed wireless signal, whether the personal mobile terminal has entered the predetermined range, so as to determine whether the maintenance operator has approached the wireless beacon.

10. The apparatus according to claim 1, wherein the personal mobile terminal is configured to be capable of automatically sensing the wireless signal without establishing a wireless connection with the wireless beacon.

11. A method for maintaining a passenger transport system, comprising the following steps:

providing a wireless beacon mounted at a registration entrance for entering the passenger transport system to perform a maintenance operation broadcasting a wireless signal to the surrounding area;

providing a personal mobile terminal carried by the maintenance operator sensing the wireless signal when the maintenance operator approaches the wireless beacon; and at least one of the wireless beacon and the personal mobile terminal automatically generating and sending, in response to successful sensing of the wireless signal by the personal mobile terminal, maintenance register information indicating that the corresponding maintenance operator has checked into a maintenance operation process;

receiving, at a maintenance management terminal, the maintenance register information and confirm, based on the received maintenance register information, that the corresponding personal mobile terminal has finished a check-in operation.

12. A method for maintaining a passenger transport system, comprising the following steps:

sensing a wireless signal that is broadcasted by a wireless beacon mounted at a registration entrance for entering the passenger transport system to perform a maintenance operation; and automatically generating, in response to successful sensing of the wireless signal, maintenance register information indicating that a corresponding maintenance operator has checked into a maintenance operation process;

sending the maintenance register information to a maintenance management terminal.

13. The method according to claim 12, further comprising the following step:

receiving a health report of the corresponding passenger transport system.

14. The method according to claim 13, further comprising the following step:

generating and presenting, based on the health report, a healthy state and/or an unhealthy state of one or more components in the passenger transport system that require maintenance.

15. The method according to claim 14, wherein in the step of presenting the health condition, one or more components that are in the unhealthy state and require maintenance are highlighted.

16. The method according to claim 13, further comprising the following step:

generating maintenance operation prompt information based on the health report and sending the maintenance operation prompt information to prompt the maintenance operator to perform a corresponding maintenance operation.

17. The method according to claim 12, wherein in the sensing step, a first identity of the wireless beacon is identified at the same time; and in the step of generating and sending maintenance register information, maintenance register information comprising the first identity and a second identity of the personal mobile terminal is generated and sent.

18. A computer device, comprising a memory, a processor, and a computer program that is stored in the memory and can be run in the processor, wherein the processor implements the steps of the method according to claim 12 when executing the program.

19. A computer readable storage medium storing a computer program, wherein the program is executed by a processor to implement the steps of the method according to claim 12.

20. A personal mobile terminal for maintaining a passenger transport system, which can be carried by a maintenance operator that performs a maintenance operation process, wherein the personal mobile terminal comprises:

a near field communication unit configured to sense a wireless signal that is broadcasted by a wireless beacon mounted at a registration entrance for entering the passenger transport system to perform a maintenance operation;

a maintenance register information generating unit configured to automatically generate, in response to successful sensing of the wireless signal, maintenance register information indicating that the maintenance operator has checked into a maintenance operation process; and a remote communication unit configured to send the maintenance register information to a maintenance management terminal.

21. A wireless beacon for maintaining a passenger transport system, wherein the wireless beacon is mounted at a registration entrance for entering the passenger transport system to perform a maintenance operation and is configured to be capable of broadcasting a wireless signal to the surrounding area; and the wireless beacon comprises:

a maintenance register information generating unit configured to automatically generate, in response to successful sensing of the wireless signal by a personal mobile terminal carried by a maintenance operator, maintenance register information indicating that the maintenance operator has checked into a maintenance operation process; and a maintenance register information sending unit configured to send the maintenance register information to a maintenance management terminal.

* * * * *